US009457446B2

(12) United States Patent
Brake et al.

(10) Patent No.: US 9,457,446 B2
(45) Date of Patent: Oct. 4, 2016

(54) METHODS AND SYSTEMS FOR USE IN GRIND SHAPE CONTROL ADAPTATION

(71) Applicant: Strasbaugh, San Luis Obispo, CA (US)

(72) Inventors: Thomas E. Brake, San Luis Obispo, CA (US); William J. Kalenian, San Luis Obispo, CA (US); David L. Grant, Thousand Oaks, CA (US)

(73) Assignee: Strasbaugh, San Luis Obispo, CA (US)

( * ) Notice: Subject to any disclaimer, the term of this patent is extended or adjusted under 35 U.S.C. 154(b) by 53 days.

(21) Appl. No.: 14/042,591

(22) Filed: Sep. 30, 2013

(65) Prior Publication Data

US 2014/0134923 A1 May 15, 2014

Related U.S. Application Data

(60) Provisional application No. 61/708,146, filed on Oct. 1, 2012.

(51) Int. Cl.

| | |
|---|---|
| ***B24B 7/02*** | (2006.01) |
| ***B24B 49/02*** | (2006.01) |
| ***B24B 51/00*** | (2006.01) |
| ***B24B 7/22*** | (2006.01) |

(52) U.S. Cl.
CPC ..... *B24B 7/228* (2013.01); *B24B 49/02* (2013.01)

(58) Field of Classification Search
CPC ..... B24B 51/00; B24B 49/00; B24B 41/00; B24B 41/02; B24B 7/00; B24B 7/10
USPC ..... 451/5, 8, 11, 28, 285–290
See application file for complete search history.

(56) References Cited

U.S. PATENT DOCUMENTS

| | | | | |
|---|---|---|---|---|
| 2,665,589 | A | | 1/1954 | Rusher |
| 2,968,133 | A | | 1/1961 | Reichardt |
| 3,142,942 | A | | 8/1964 | Celovsky |
| 3,715,841 | A | * | 2/1973 | Schnellman et al. ..... 451/22 |
| 3,885,925 | A | | 5/1975 | Tatar |
| 4,109,552 | A | | 8/1978 | Imoberdorf |
| 4,897,362 | A | | 1/1990 | Delgado |
| 5,067,085 | A | | 11/1991 | Wenzel |
| 5,240,883 | A | | 8/1993 | Abe |
| 5,718,619 | A | | 2/1998 | Merrill |
| 5,964,646 | A | | 10/1999 | Kassir et al. |
| 6,090,688 | A | | 7/2000 | Ogawa |

(Continued)

FOREIGN PATENT DOCUMENTS

| | | |
|---|---|---|
| JP | 2006120757 | 5/2006 |
| WO | 2013059705 | 4/2013 |
| WO | 2013106777 | 7/2013 |

OTHER PUBLICATIONS

USPTO; Non-final office action from U.S. Appl. No. 13/656,514; Jul. 24, 2014; 25 pgs.

(Continued)

*Primary Examiner* — Monica Carter
*Assistant Examiner* — Lauren Beronja
(74) *Attorney, Agent, or Firm* — Fitch, Even, Tabin & Flannery LLP

(57) ABSTRACT

A method of grinding wafers includes determining thickness variations in a wafer; determining incremental adjustments to spindle alignment based on best fit predictions of wafer shaper; and implemented the incremental adjustments to spindle alignment of a grind module.

3 Claims, 16 Drawing Sheets

(56) References Cited

U.S. PATENT DOCUMENTS

| | | | | |
|---|---|---|---|---|
| 6,190,234 | B1 | 2/2001 | Swedek | |
| 6,254,155 | B1 | 7/2001 | Kassir | |
| 6,336,849 | B1 | 1/2002 | Koennemann | |
| 6,343,980 | B1 | 2/2002 | Abe | |
| 6,386,956 | B1 | 5/2002 | Sato | |
| 6,402,589 | B1 | 6/2002 | Inaba et al. | |
| 6,534,384 | B2 | 3/2003 | Nakano | |
| 6,624,047 | B1 | 9/2003 | Sakaguchi | |
| 6,638,389 | B2 | 10/2003 | Kassir et al. | |
| 6,866,564 | B2 | 3/2005 | Strasbaugh et al. | |
| 6,976,901 | B1 | 12/2005 | Halley et al. | |
| 7,004,818 | B1 | 2/2006 | Haney | |
| 7,014,540 | B2 | 3/2006 | Nagel | |
| 7,018,268 | B2 | 3/2006 | Kassir et al. | |
| 7,022,000 | B2 | 4/2006 | Mizomoto et al. | |
| 7,059,942 | B2 | 6/2006 | Strasbaugh et al. | |
| 7,118,446 | B2 | 10/2006 | Walsh et al. | |
| 7,160,808 | B2 | 1/2007 | Kassir | |
| 7,402,093 | B2 | 7/2008 | Sjolander | |
| 7,458,878 | B2 | 12/2008 | Walsh et al. | |
| 8,133,093 | B2 | 3/2012 | Vogtmann et al. | |
| 8,520,222 | B2 | 8/2013 | Schraub et al. | |
| 8,968,052 | B2 | 3/2015 | Walsh | |
| 2001/0002359 | A1 | 5/2001 | Matsuo | |
| 2002/0006768 | A1 | 1/2002 | Wada et al. | |
| 2002/0042243 | A1 | 4/2002 | Ihsikawa | |
| 2002/0102144 | A1 | 8/2002 | Linderholm | |
| 2002/0127950 | A1 | 9/2002 | Hirose | |
| 2003/0124961 | A1 | 7/2003 | Haney | |
| 2003/0232581 | A1 | 12/2003 | Ki | |
| 2004/0011462 | A1* | 1/2004 | Gotkis | B24B 1/005 156/345.13 |
| 2004/0053500 | A1 | 3/2004 | Shemer | |
| 2004/0063385 | A1 | 4/2004 | Perlov | |
| 2004/0124509 | A1 | 7/2004 | Kim | |
| 2005/0026543 | A1 | 2/2005 | Han | |
| 2005/0176350 | A1 | 8/2005 | Gerber | |
| 2005/0227587 | A1 | 10/2005 | Yang | |
| 2006/0194513 | A1 | 8/2006 | Saxler | |
| 2007/0128983 | A1 | 6/2007 | Walsh et al. | |
| 2008/0090505 | A1* | 4/2008 | Yoshida et al. | 451/413 |
| 2009/0203299 | A1* | 8/2009 | Kashiwa et al. | 451/360 |
| 2010/0285665 | A1 | 11/2010 | Takai et al. | |
| 2011/0014774 | A1 | 1/2011 | Johnson | |
| 2012/0239182 | A1* | 9/2012 | Kikata et al. | 700/186 |
| 2013/0102227 | A1 | 4/2013 | Walsh et al. | |
| 2013/0130593 | A1 | 5/2013 | Kalenian et al. | |

OTHER PUBLICATIONS

Sony; "Digital Gauge Measuring Unit DK Series"; Catalog #497; 2005; 2 Pages.

Heidenhain Encoders; "Heidenhain Magnetic Modular Encoders" Internet Catalog; At least Jul. 2011; 1 Page.

THK; "Features of the Cross-Roller Ring—THK Technical Support"; Published before Oct. 2011; 3 Pages.

Tamar Technology; WTS Optical Head; Published before Oct. 21, 2011; 4 Pages.

Tamar Technology; Reference Manual for Wafer Thickness Sensor <WTS) WinSock Server; Version 1.0; Feb. 15, 2011; 23 Pages.

PCT; Notification of Transmittal of the International Search Report and the Written Opinion of the International Searching Authority issued in International Patent Application No. PCT/US2012/061169; Mailed Mar. 8, 2013; 2 pages.

PCT; International Search Report issued in International Patent Application No. PCT/US2012/061169; Mailed Mar. 8, 2013; 3 pages.

PCT; Written Opinion of the International Searching Authority issued in International Patent Application No. PCT/US2012/061169; Mailed Mar. 8, 2013; 4 pages.

PCT; Notification of Transmittal of the International Search Report and the Written Opinion of the International Searching Authority issued in International Patent Application No. PCT/US2013/021319; Mailed Mar. 19, 2013; 2 pages.

PCT; International Search Report issued in International Patent Application No. PCT/US2013/021319; Mailed Mar. 19, 2013; 2 pages.

PCT; Written Opinion of the International Searching Authority issued in International Patent Application No. PCT/US2013/021319; Mailed Mar. 19, 2013; 4 pages.

Walsh et al.; U.S. Appl. No. 14/042,600, filed Sep. 30, 2013; 39 Pages.

USPTO; Non-Final Office Action from U.S. Appl. No. 14/042,600 mailed Mar. 3, 2015.

USPTO; Notice of Allowance from U.S. Appl. No. 13/656,514 mailed Oct. 30, 2014.

Puligadda et al.; "High-Performance Temporary Adhesives for Wafer Bonding Applications"; Enabling Technologies for 3-D Integration; Mater. Res. Soc. Symp. Proc. vol. 970; 2007; 18 pages.

USPTO; Non-Final Office Action from U.S. Appl. No. 13/740,101 mailed Nov. 2, 2015.

USPTO; Non-final office action issued in U.S. Appl. No. 14/042,600 mailed Oct. 2, 2015.

USPTO; Notice of Allowance from U.S. Appl. No. 13/740,101 mailed Mar. 11, 2016.

* cited by examiner

Model 7AH Powered Spindle Alignment Detail View

Model 7AH Powered Spindle Alignment Detail Section View

Powered Spindle Alignment Detail Section View - Close-up

First Example of Spindle Alignment

| | | |
|---|---|---|
| Grind Wheel Stone Centerline Diameter | = | 258 mm |
| Grind Wheel Stone Centerline to Wafer Center | = | 0 mm |
| Diameter of Wafer | = | 300 mm |
| Roll (β, front to back) Spindle Alignment | = | 0.00050 deg |
| Pitch (α, side to side) Spindle Alignment | = | -0.00038 deg |

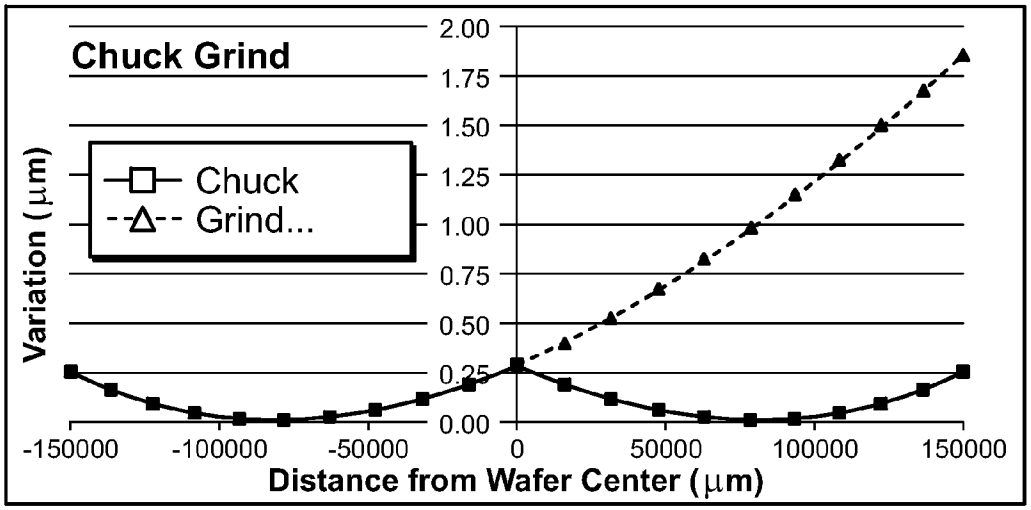

| | | |
|---|---|---|
| Grind Wheel Stone Centerline Diameter | = | 273 mm |
| Grind Wheel Stone Centerline to Wafer Center | = | 0 mm |
| Diameter of Wafer | = | 300 mm |
| Roll (β, front to back) Spindle Alignment | = | 0.00025 deg |
| Pitch (α, side to side) Spindle Alignment | = | -0.00038 deg |

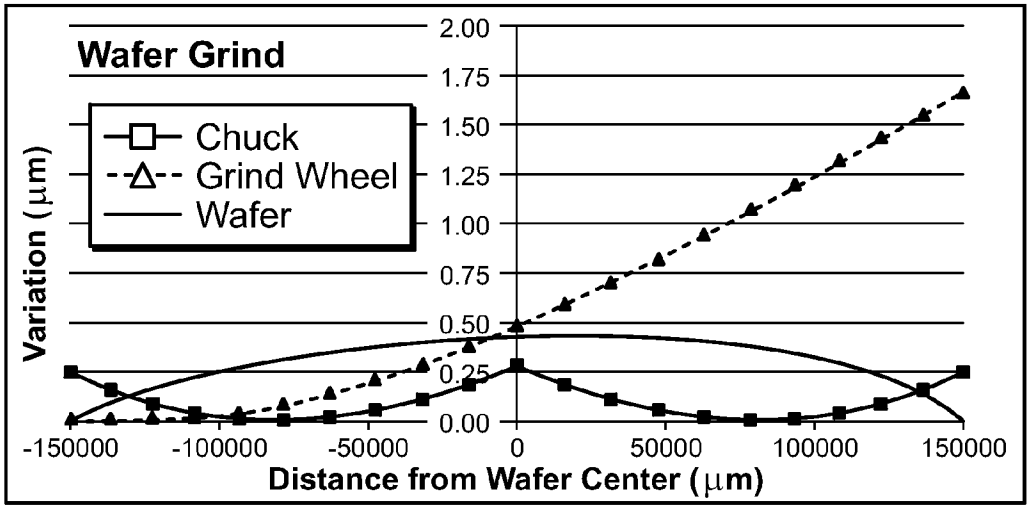

*FIG. 9*

Second Example of Spindle Alignment

| | | |
|---|---|---|
| Grind Wheel Stone Centerline Diameter | = | 258 mm |
| Grind Wheel Stone Centerline to Wafer Center | = | 0 mm |
| Diameter of Wafer | = | 300 mm |
| Roll (β, front to back) Spindle Alignment | = | 0.00050 deg |
| Pitch (α, side to side) Spindle Alignment | = | -0.00038 deg |

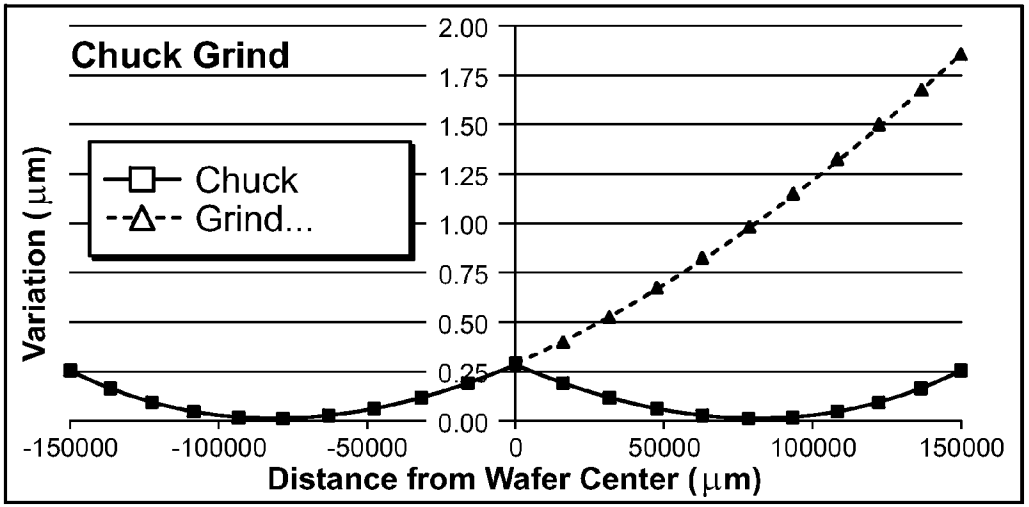

| | | |
|---|---|---|
| Grind Wheel Stone Centerline Diameter | = | 273 mm |
| Grind Wheel Stone Centerline to Wafer Center | = | 0 mm |
| Diameter of Wafer | = | 300 mm |
| Roll (β, front to back) Spindle Alignment | = | -0.00025 deg |
| Pitch (α, side to side) Spindle Alignment | = | 0.00000 deg |

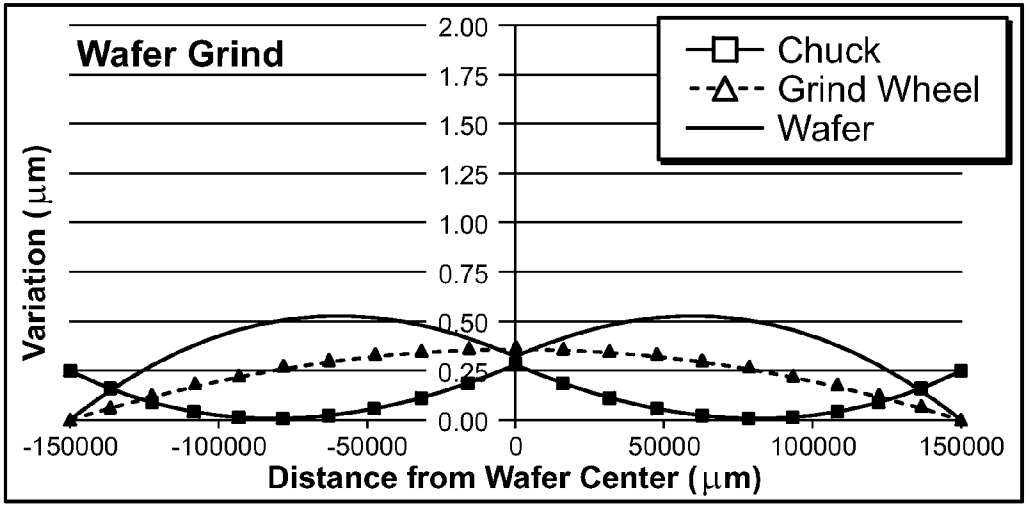

*FIG. 10*

Third Example of Spindle Alignment

| | | |
|---|---|---|
| Grind Wheel Stone Centerline Diameter | = | 258 mm |
| Grind Wheel Stone Centerline to Wafer Center | = | 0 mm |
| Diameter of Wafer | = | 300 mm |
| Roll (β, front to back) Spindle Alignment | = | -0.00063 deg |
| Pitch (α, side to side) Spindle Alignment | = | 0.00000 deg |

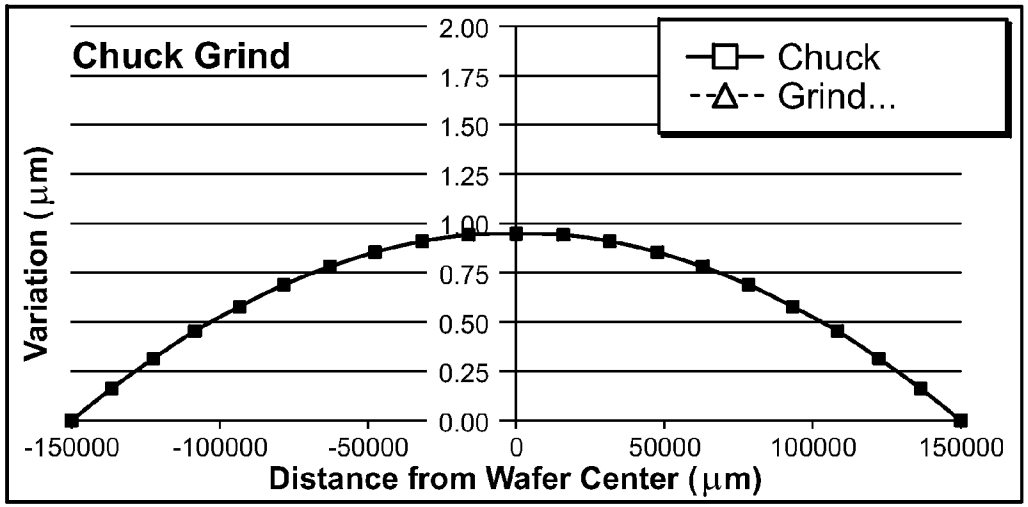

| | | |
|---|---|---|
| Grind Wheel Stone Centerline Diameter | = | 273 mm |
| Grind Wheel Stone Centerline to Wafer Center | = | 0 mm |
| Diameter of Wafer | = | 300 mm |
| Roll (β, front to back) Spindle Alignment | = | -0.00025 deg |
| Pitch (α, side to side) Spindle Alignment | = | 0.00000 deg |

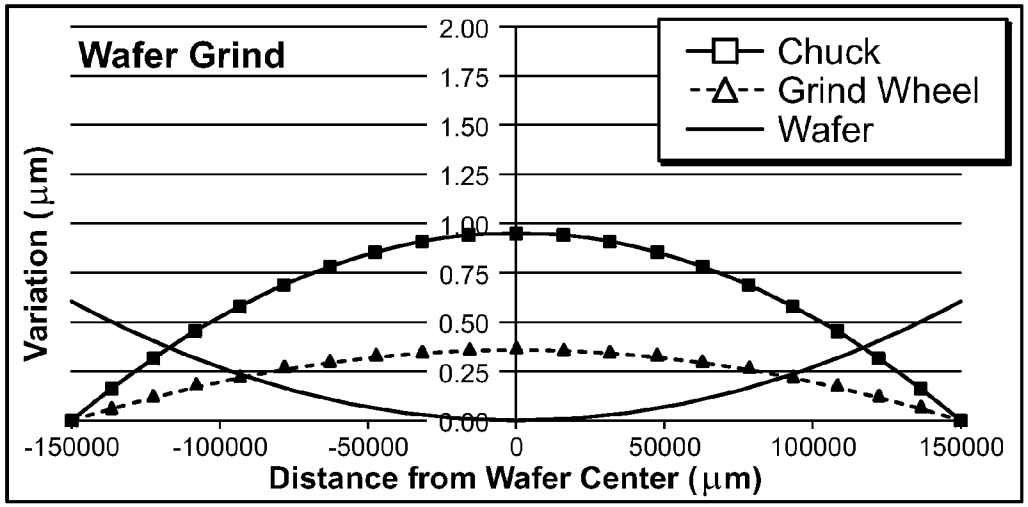

*FIG. 11*

Fourth Example of Spindle Alignment

| | | |
|---|---|---|
| Grind Wheel Stone Centerline Diameter | = | 258 mm |
| Grind Wheel Stone Centerline to Wafer Center | = | 0 mm |
| Diameter of Wafer | = | 300 mm |
| Roll (β, front to back) Spindle Alignment | = | -0.00063 deg |
| Pitch (α, side to side) Spindle Alignment | = | 0.00000 deg |

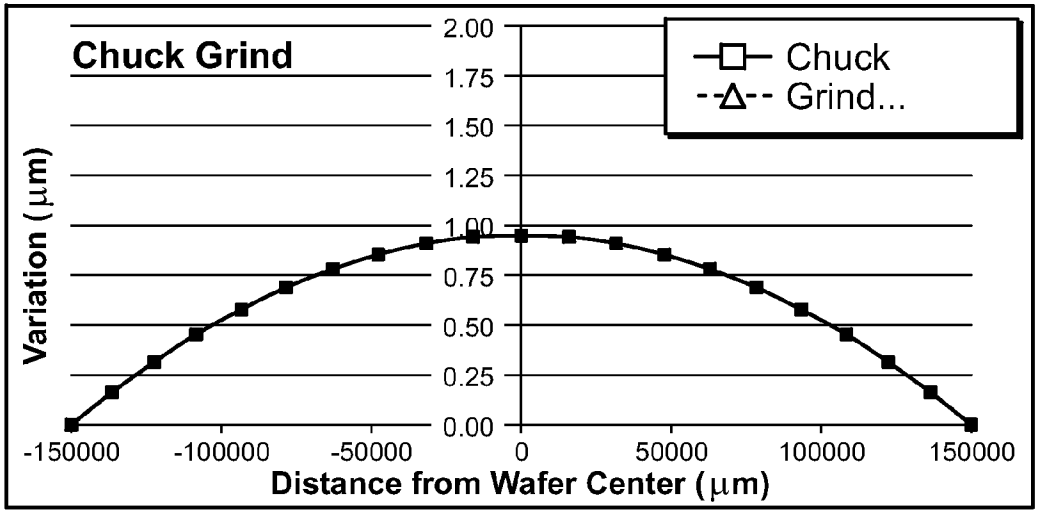

| | | |
|---|---|---|
| Grind Wheel Stone Centerline Diameter | = | 273 mm |
| Grind Wheel Stone Centerline to Wafer Center | = | 0 mm |
| Diameter of Wafer | = | 300 mm |
| Roll (β, front to back) Spindle Alignment | = | -0.00100 deg |
| Pitch (α, side to side) Spindle Alignment | = | 0.00000 deg |

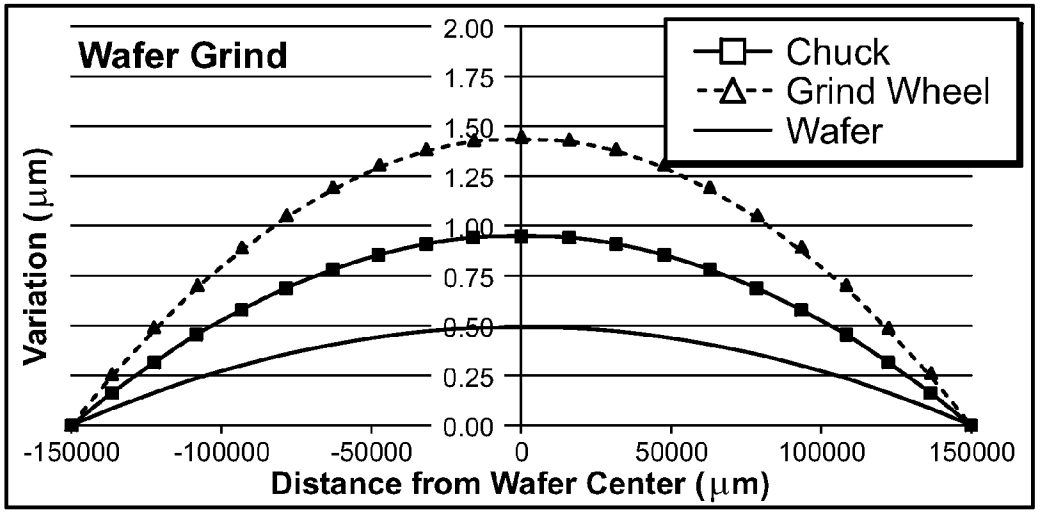

*FIG. 12*

Sixth Example of Spindle Alignment

Grind Wheel Stone Centerline Diameter = 258 mm
Grind Wheel Stone Centerline to Wafer Center = 0 mm
Diameter of Wafer = 300 mm
Roll (β, front to back) Spindle Alignment = -0.00063 deg
Pitch (α, side to side) Spindle Alignment = 0.00000 deg

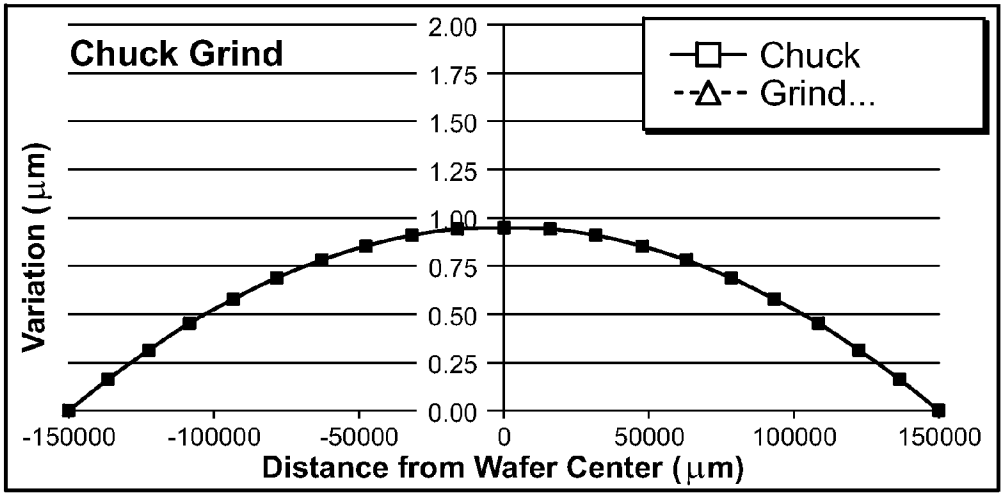

Grind Wheel Stone Centerline Diameter = 273 mm
Grind Wheel Stone Centerline to Wafer Center = 0 mm
Diameter of Wafer = 300 mm
Roll (β, front to back) Spindle Alignment = -0.00063 deg
Pitch (α, side to side) Spindle Alignment = 0.00025 deg

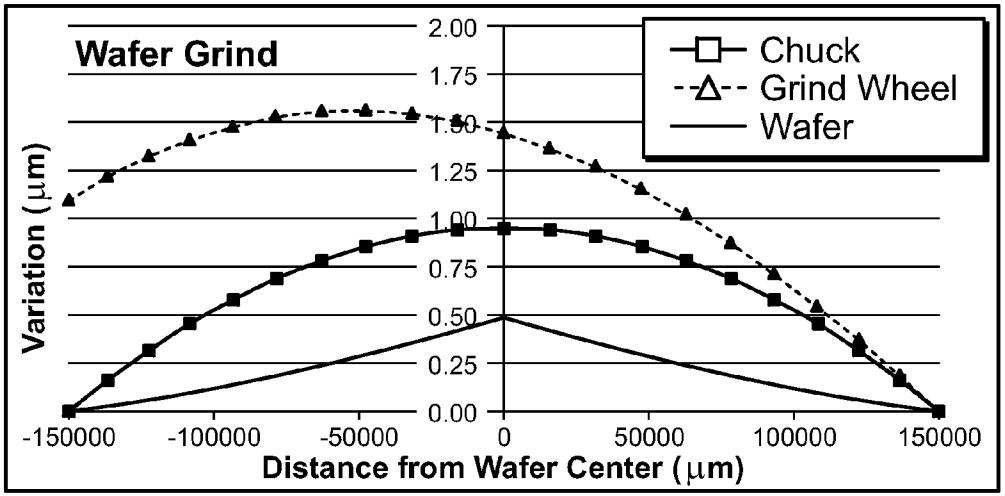

*FIG. 14*

METHODS AND SYSTEMS FOR USE IN GRIND SHAPE CONTROL ADAPTATION

This application claims the benefit of U.S. Provisional Application No. 61/708,146, filed Oct. 1, 2012, for METHODS AND SYSTEMS FOR USE IN GRIND SHAPE CONTROL ADAPTATION, which is incorporated in its entirety herein by reference.

SUMMARY OF THE INVENTION

Some embodiments provide a method of grinding wafers, comprising: determining thickness variations in a wafer; determine incremental adjustments to spindle alignment based on best fit predictions of wafer shape; and implementing the incremental adjustments to spindle alignment of a grind module.

Some embodiments provide a method of measuring wafers, comprising: determining thickness variations in a wafer in a grind module from a single stationary thickness probe by combining the motions of: a. wafer rotation on the grind chuck; and b. indexer motion to sweep across the wafer diameter; and determining a wafer shape and thickness map over the entire wafer based on determined thickness variations.

Some embodiments provide a grind module, comprising: grind spindle; and one or more grind wheel spindle adjustment screw assemblies associated with the grind spindle, where the one or more grind wheel spindle adjustment screw assemblies are configured to adjust alignment of the grind spindle.

BRIEF DESCRIPTION OF THE DRAWINGS

FIG. 9 illustrates a first example of using algorithms based in three dimensional solid model geometry to correlate chuck shape to wafer size, grind wheel size and spindle alignments; and wafer shape to chuck shape, wafer size, grind wheel size and spindle alignments.

FIG. 10 illustrates a second example of using algorithms based in three dimensional solid model geometry to correlate: chuck shape to wafer size, grind wheel size and spindle alignments; and wafer shape to chuck shape, wafer size, grind wheel size and spindle alignments.

FIG. 11 illustrates a third example of using algorithms based in three dimensional solid model geometry to correlate: chuck shape to wafer size, grind wheel size and spindle alignments; and wafer shape to chuck shape, wafer size, grind wheel size and spindle alignments.

FIG. 12 illustrates a fourth example of using algorithms based in three dimensional solid model geometry to correlate: chuck shape to wafer size, grind wheel size and spindle alignments; and wafer shape to chuck shape, wafer size, grind wheel size and spindle alignments.

FIG. 14 illustrates a sixth example of using algorithms based in three dimensional solid model geometry to correlate: chuck shape to wafer size, grind wheel size and spindle alignments; and wafer shape to chuck shape, wafer size, grind wheel size and spindle alignments.

DETAILED DESCRIPTION

Figure 1:
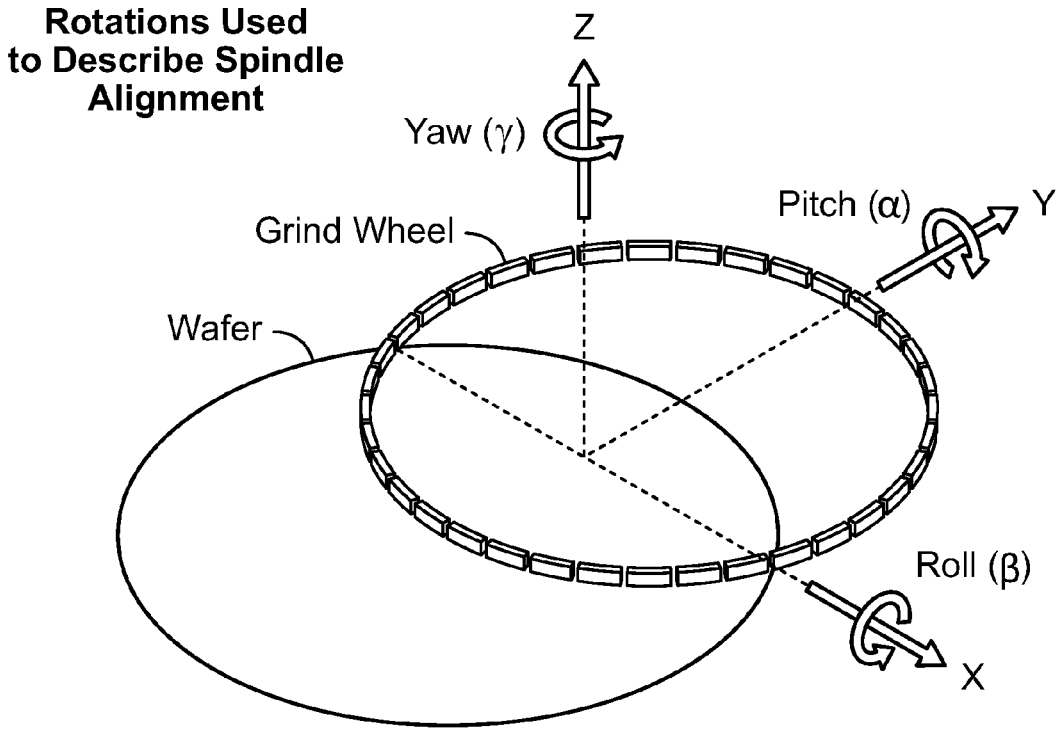
FIG. 1 illustrates a graphical representation of pitch, roll, and yaw in association with a portion of a grind wheel positioned relative to a wafer.

Reference throughout this specification to "one embodiment," "an embodiment," "some embodiments," "some implementations" or similar language means that a particular feature, structure, or characteristic described in connection with the embodiment is included in at least one embodiment of the present invention.

Thus, appearances of the phrases "in one embodiment," "in an embodiment," "in some embodiments," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of configurations, cooperation between components, processing, coordination, programming, software modules, user interfaces, user operations and/or selections, communications and/or network transactions, memory and/or database queries, database structures, hardware modules, hardware circuits, hardware chips, etc., to provide a thorough understanding of embodiments of the invention. One skilled in the relevant art will recognize, however, that the invention can be practiced without one or more of the specific details, or with other structures, features, methods, components, materials, and so forth. In other instances, well-known structures, materials, or operations are not shown or described in detail to avoid obscuring aspects of the invention.

Some embodiments provide methods and systems for improving the grinding of substrates, including but not limited to semiconductor wafer grinding. For example, some embodiments provide for silicon wafer grinding for semiconductors and/or other relatively hard materials wafer grinding. As a further example, miniature semiconductor and related devices are commonly manufactured on round, flat wafers made from hard materials, and often single-crystal materials that require surfacing to achieve extremely smooth and uniform surface-finish conditions. Grinding is typically done with grind engines, grind module or grinders that direct or plunge a rotating diamond abrasive cup-shaped wheel (grind wheel) into the surface of a rotating substrate (e.g., wafer). Relative alignment of the grind wheel to the wafer, at least in part, can determine a post-grind wafer shape.

Often the goal of grinding a wafer is to produce a specified shape to the wafer. Most traditional grinding produces a flat wafer. Present embodiments allow grinding of a wafer or a wafer-stack deliberately to a non-flat shape. In some implementations, a non-flat shape is desirable when the wafer being ground (ground wafer) is mounted upon a second "carrier" wafer or "carrier" wafer stack (carrier wafer), which itself is not flat and the goal is to produce a ground wafer that is of constant thickness. A non-flat shape is also desirable when the wafer is exposed to subsequent processes that do not produce uniform shapes, e.g. etching.

Spindle alignment is often one of the most critical variables that affect postgrind wafer surface shape. A grind wheel plane is determined by an alignment of a rotating spindle that rotates a grind wheel with attached abrasive elements (grind wheel spindle). A wafer plane is determined by an alignment of a rotating spindle that rotates a chuck that supports a wafer (chuck spindle). The relative alignment of the grind wheel spindle to the chuck spindle (spindle alignment) determines, at least in part, the resulting wafer surface shape produced from grinding the wafer.

Further, the wafer surface shape is determined, at least in part, by the shape of the chuck surface to which the wafer is firmly attached during grinding (often by vacuum applied through a porous chuck, e.g., ceramic chuck). During setup of a grind module, a chuck surface can be ground by the grind engine (e.g., using the grind wheel). By using the same spindle alignment used to grind the chuck surface and imparting the same grind force, ground wafer shapes result in very uniform wafer thickness.

Combinations of work chuck shapes and spindle alignment can produce desirable shapes and surface finishes not achievable with very flat chucks and corresponding aligned spindles.

According to Euler's rotation theorem, any rotation may be described using three angles. For purposes here, spindle alignment can be expressed as:

- Pitch ($\alpha$), or side to side, defined as a rotation about the cord created from the intersection of the grind wheel stone centerline and an outer perimeter of the wafer.
- Roll ($\beta$), or front to back, defined as a rotation about a line perpendicular to pitch and perpendicular to the chuck spindle axis of rotation.
- Yaw ($\gamma$), or rotation, defined as a rotation about the chuck spindle axis of rotation.

FIG. 1 illustrates a graphical representation of pitch, roll, and yaw in association with a portion of a grind wheel positioned relative to a wafer.

Figure 2:
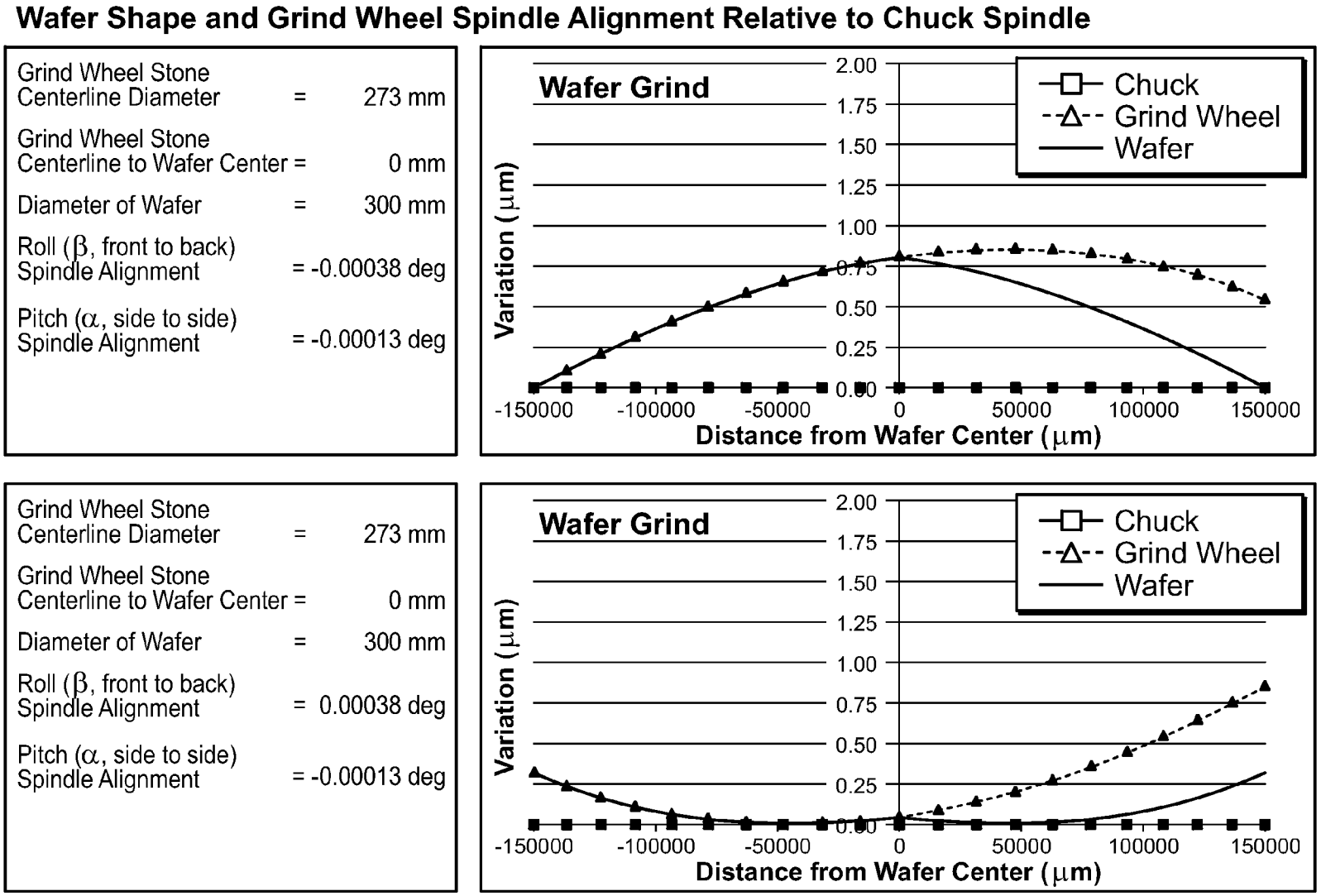
FIG. 2 illustrates graphical representations of qualitative examples of the effect of changing a spindle alignment, in accordance with some embodiments.

FIG. 2 illustrates graphical representations of qualitative examples of the effect of changing the spindle alignment, in accordance with some embodiments. A procedure, in accordance with some embodiments, to implement adjustments to spindle alignment is to fix the chuck spindle and make adjustments affecting one or more rotational angles of the grind wheel spindle. Another procedure, in accordance with some embodiments, is to fix the grind wheel spindle and make adjustments affecting one or more rotational angles of the chuck spindle. Another procedure, in accordance with some embodiments, is to make adjustments affecting one or more rotational angles of the grind wheel spindle and chuck spindle. However, adjustments are typically relatively small and precise so adjustment of just one of the spindles is often sufficient for most applications.

Figure 3:
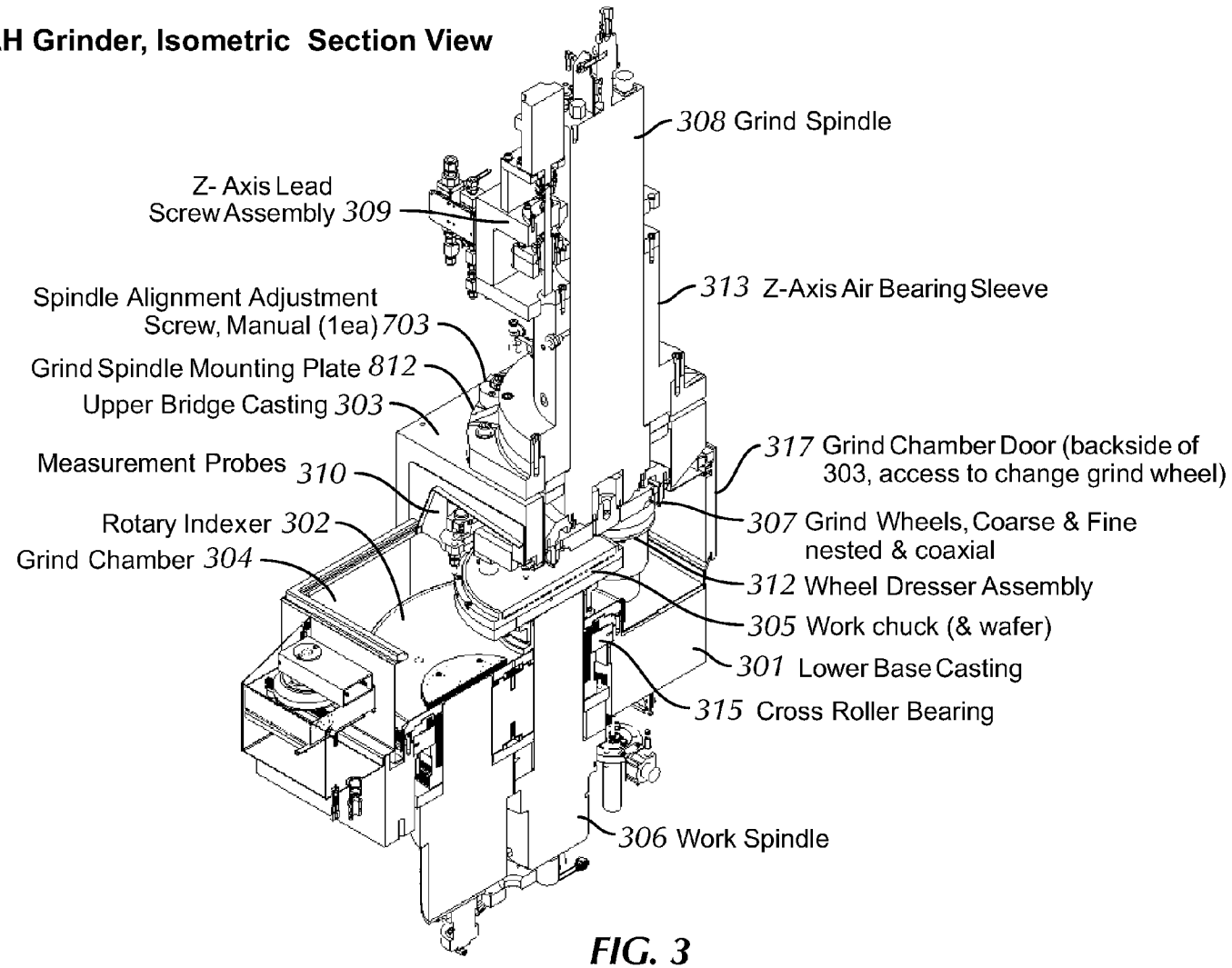
FIG. 3 depicts a partial cross-sectional view of a grind module or engine in accordance with some embodiments.

FIG. 3 depicts a partial cross-sectional view of a grind module or engine in accordance with some embodiments. For example, the grind module can be implemented through one of the grind systems and/or engines and/or incorporate some or all of the components of the grind systems and/or engines described in U.S. Provisional Application No. 61/549,787, filed Oct. 21, 2011, entitled SYSTEMS AND METHODS OF WAFER GRINDING, and U.S. Provisional Application No. 61/585,643, filed Jan. 11, 2012, entitled SYSTEMS AND METHODS OF PROCESSING SUBSTRATES, which are incorporated herein by reference in their entirety.

Figure 4:
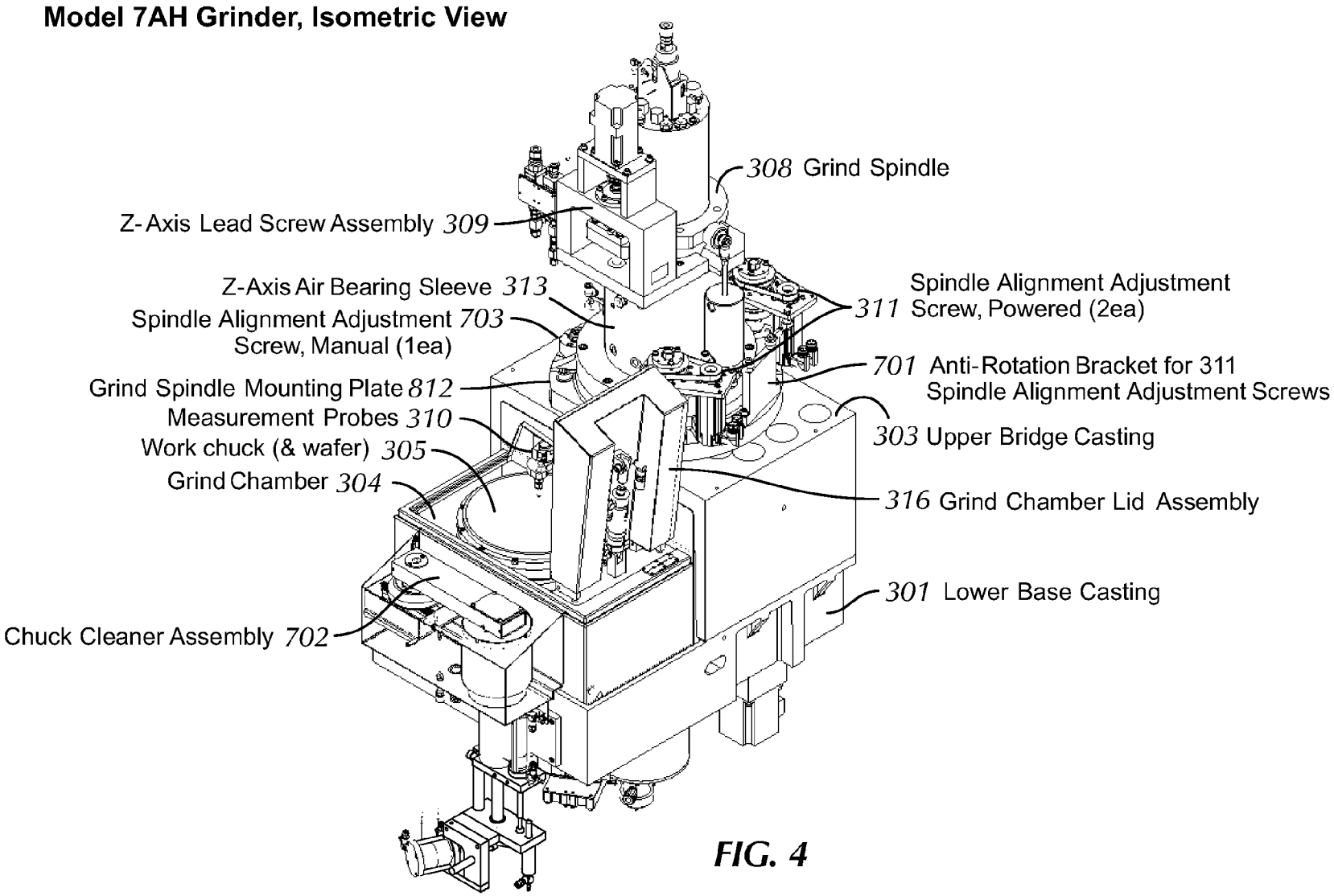
FIG. 4 depicts a perspective view of the grind module of FIG. 3.
Figure 5:
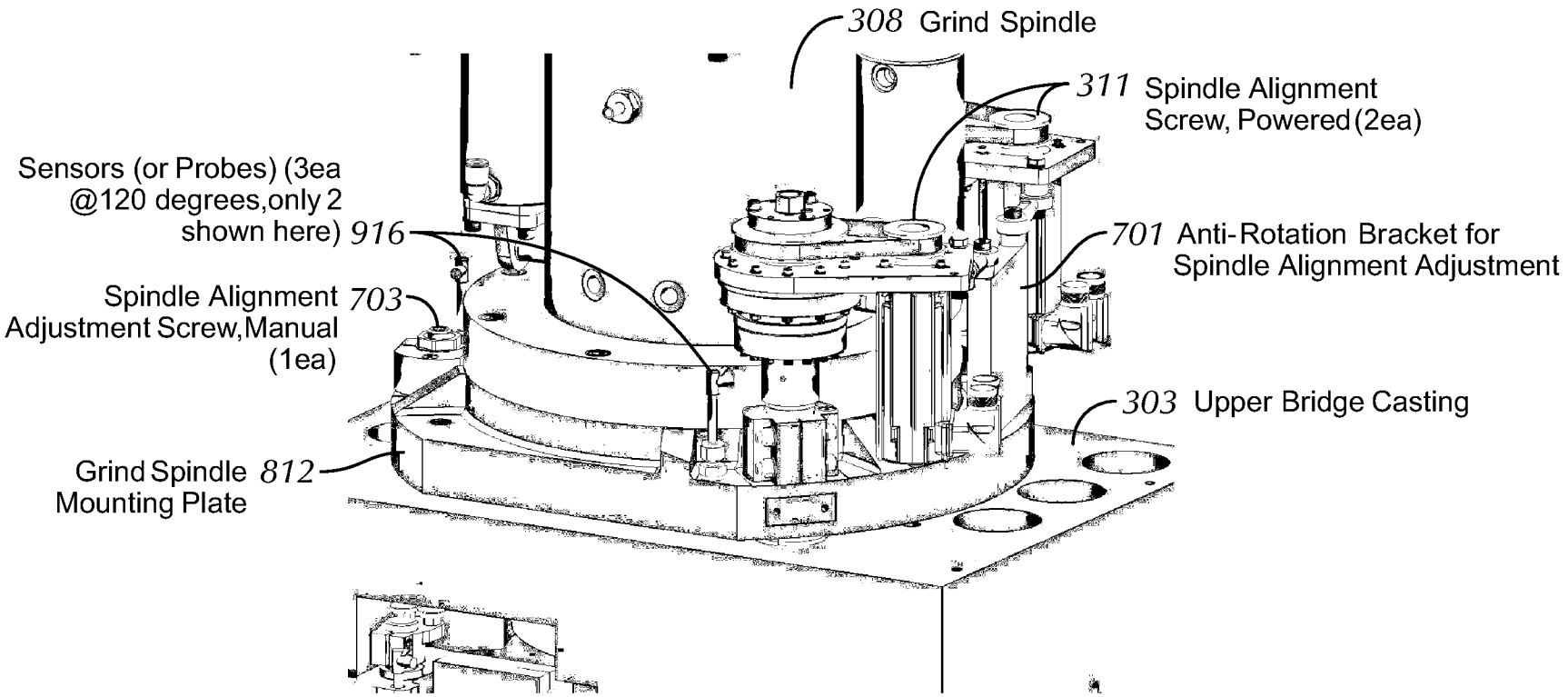
FIG. 5 depicts a partial, perspective view of a grind wheel spindle adjustment screw assemblies, in accordance with some embodiments.
Figure 6:
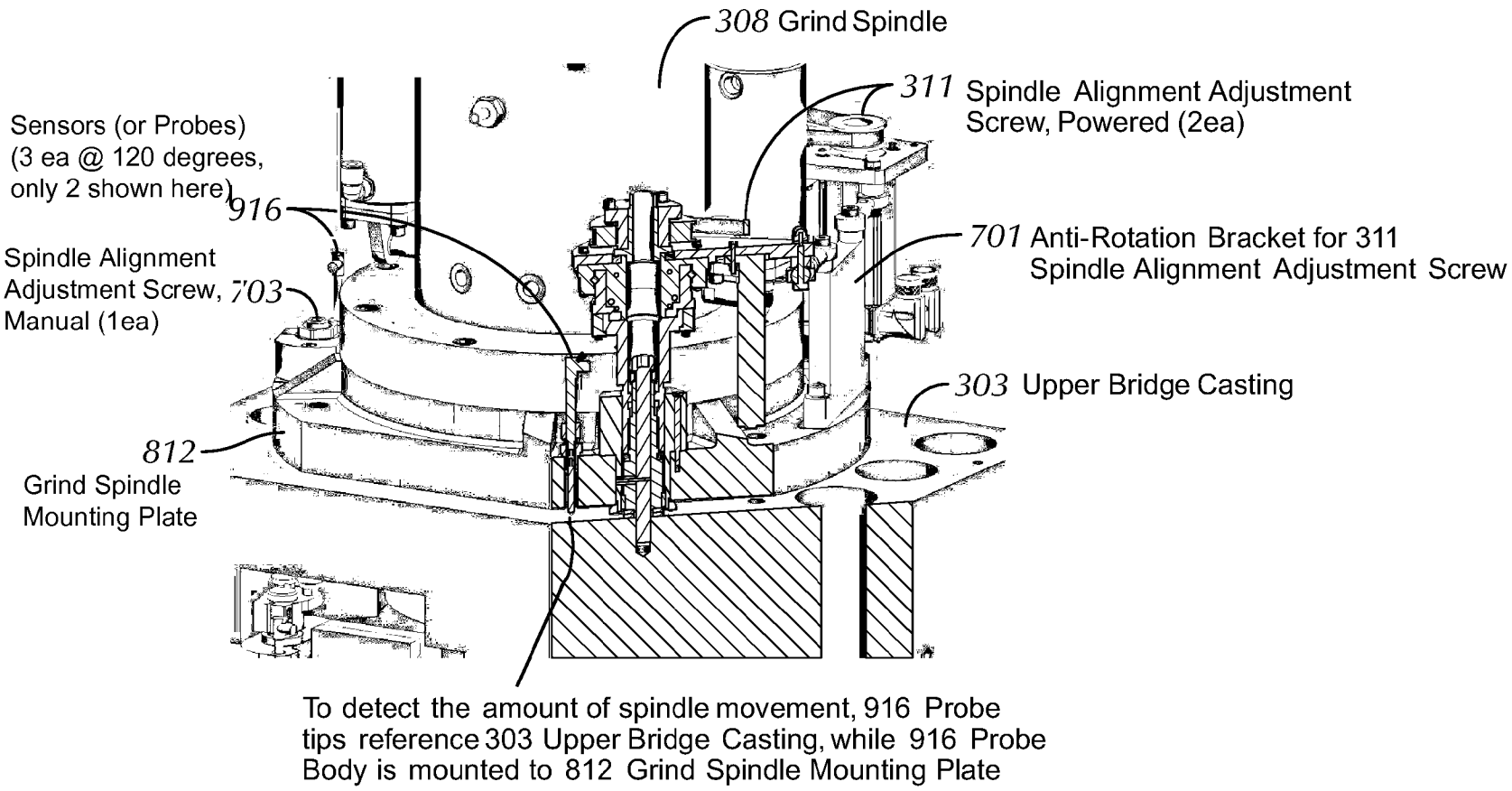
FIG. 6 depicts a partial, cross-sectional view of a grind wheel spindle adjustment screw assemblies of FIG. 5 cooperated with a grind module.
Figure 7:
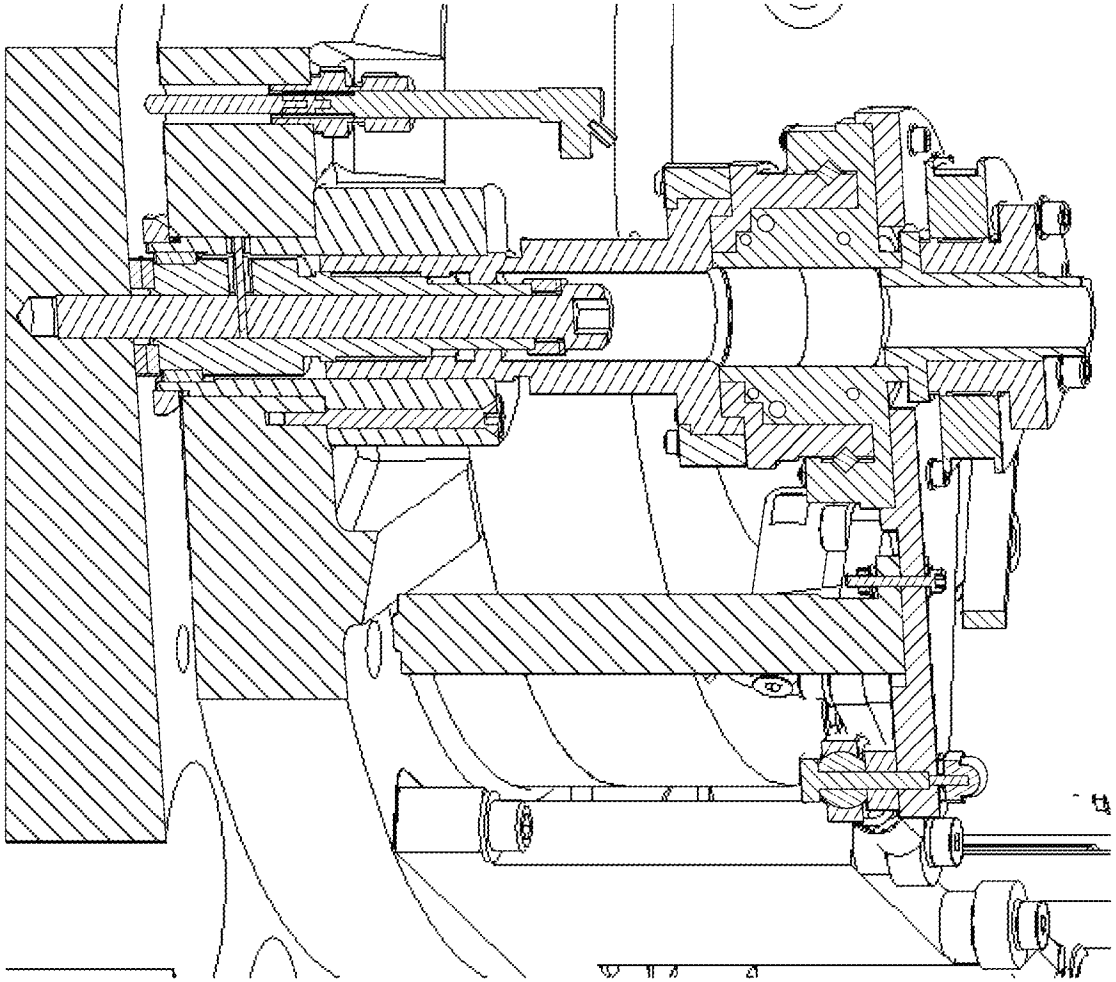
FIG. 7 depicts an enlarged view of a partial, cross-sectional view of the grind wheel spindle adjustment screw assembly of FIG. 6.

FIG. 4 depicts a perspective view of the grind module of FIG. 3. The grind module includes a series of grind wheel spindle adjustment screw assemblies 311 and 703 that cooperate with and/or are associated with the grind wheel spindle 308 to at least in part implement spindle alignment. FIG. 5 depicts a partial, perspective view of the grind wheel spindle adjustment screw assemblies 311, in accordance with some embodiments and that can be incorporated into a grind module or engine, such as the grind module of FIG. 3. FIG. 6 depicts a partial, cross-sectional view of the grind wheel spindle adjustment screw assemblies 311 of FIG. 5 cooperated with the grind module. FIG. 7 depicts an enlarged view of the partial, cross-sectional view of the grind wheel spindle adjustment screw assembly 311 of FIG. 6.

In some embodiments, the grind module includes a series of three grind wheel spindle adjustment screw assemblies 311 and/or 703 located at approximately 120 degrees from one another. The grind wheel spindle adjustment assemblies 311, 703 allow the three-dimensional adjustments to be made to one or more angles of the grind wheel spindle. In some embodiments, the adjustments to the grind wheel spindle can be implemented by manually turning one or more adjustment screws of a manual grind wheel spindle adjustment assembly 703; activating adjustments to one or more automated spindle adjustment assemblies 311; and/or implementing corresponding adjustments that transfer the adjustments to the adjustment screws that affect spindle pitch and roll. Pitch angle is perpendicular to roll angle so combinations can be used to achieve desired shape.

Typically, the process or procedure of setting up, aligning and/or adjusting the spindle alignment is a multi-step process. In some instances, this process uses instrumentation (e.g. a very flat plate attached to the chuck spindle and indicators attached to the grind wheel) that is installed on the grind module and later removed.

Further, some embodiments additionally implement trial and error approaches to spindle alignment, and actual wafer grinding to provide for data used to evaluate alignment. This "trial and error" process can take a relatively long time (hours or days) and typically must be implemented by an experienced technician and/or process engineer to evaluate post-grind test wafer shapes and make decisions about which adjustment screws to adjust, which direction to adjust them, and how much to adjust them to achieve the desired wafer surface shape.

Additionally, for some applications, the wafer is to be ground so thin that it is very difficult and often impractical to handle the wafer without damage unless it is "stacked" or attached onto one or more "carrier" substrates or wafers. The ground wafer is the wafer of interest, while the one or more carrier wafers or other such substrates are used to provide a sturdy support for the ground wafer, which is ground to a desired thickness, profile and/or shape, and in some instances, 15 microns or less. When stacked wafers are being ground, as is common for example in Backside Illumination (BSI), Silicon on Insulator (SOI), Through-Silicon Vias (TSV) and other such applications, the carrier wafer or substrate used to fix the ground wafers during grinding may have different shapes that contribute to the post-grind surface shape of the ground wafer being ground. This is because the carrier wafer forms an intermediate shape between the pre-shaped chuck and the ground wafer. Variations in the carrier wafers can therefore mirror through to the ground wafer during grinding. Manually adjusting spindle alignment for optimal grinding of each distinct wafer based upon corresponding carrier shape can, in some instances, be time consuming and can be impractical for some applications, such as some high production fabrication facilities.

Some embodiments described herein, however, provide apparatuses and methods to automate grinder, grind module setup to achieve a desired and/or optimal spindle alignment for single wafer and/or stacked wafer operations. In many embodiments, when implementing single wafer grinding (e.g., not a stacked wafer), the setup for a given wafer chuck is assumed to remain fixed over time.

Below is described a method for grind module setup for grinding single wafers mounted on clean grind chuck:

1. Grind a first wafer (wafer A).
2. Post-grind measurement and implement corrective adjustment (a corrective adjustment is one that causes incremental adjustments to spindle alignment, post-grind, to optimize ground wafer shaping to minimize variations from a target wafer thickness profile):
   a. Perform post-grind wafer thickness measurements of the first ground wafer (wafer A) thickness at a statistically significant number of points to support an accurate radial thickness profile, e.g., measured in the grind module, such as using an embedded thickness measurement device; or remove ground wafer from grind module and measure the wafer using a separate measurement system (e.g., an ADE model 9500 from KLA Tencor, a Tamar WaferScan system from Tamar Technology, or other such relevant measurement systems).
   b. Compare the measured shape of the first wafer ground (wafer A) with the target wafer thickness profile (e.g., compare thicknesses between actual to target along wafer diameters). Generate a map of target thickness variation between actual and target thickness over the wafer diameter (target thickness variation map).
   c. Using algorithms based in three-dimensional, solid model geometry to calculate wafer shape based on wafer size, grind wheel size and spindle alignments, determine the incremental pitch and roll that generate a best fit of a computed incremental thickness variation map to the measured target thickness variation map. For example, the determination of the alignment adjustments to implement can, in some embodiments, include some or all of the information determined and described in U.S. Provisional Application No. 61/549,787, filed Oct. 21, 2011, entitled SYSTEMS AND METHODS OF WAFER GRINDING, which is incorporated herein by reference in its entirety.
   d. Spindle pitch and roll is manually or automatically, incrementally adjusted based on the result from a best fit of a computed incremental thickness variation map to the measured target thickness variation map. For example, adjustments can be implemented to one or more grind wheel spindle adjustment screw assemblies 311, 703 described in concurrently filed U.S. Provisional Application No. 61/708,165, filed Oct. 1, 2012, entitled Methods and System for Use in Grind Spindle Alignment, which is incorporated herein by reference in its entirety.
3. In some embodiments, the above steps may be repeated for one or more subsequent wafers (e.g., a predefined number, randomly selected, etc.) or for each wafer.

Below is described a method for grinding module setup for grinding a series of stacked wafers mounted on a clean grind chuck:

For a series of stacked wafers, each with variations in carrier wafer shape, some embodiments implement measurements of each carrier wafer shape. Based on the measurements, automated, incremental adjustments are made to spindle alignment to accommodate each carrier wafer, so as to achieve desired final ground wafer shape. Below is described a process in accordance with some embodiments of implementing an automated spindle adjustment to achieve a desired ground wafer thickness profile.

1. Pre-grind measurement and implement predictive adjustment (a predictive adjustment is one that causes incremental adjustments to spindle alignment, pre-grind, to optimize ground wafer shaping for varying carrier wafer shapes to minimize variations from target wafer thickness profile):
   a. Pre-measure (e.g., diameter scans) a carrier wafer, when grinding stacked wafers, to determine the carrier wafer shape, e.g., measure in a Tamar Wafer Scan system, or measure in the grind module using, for example, an embedded thickness measurement device.
   b. Compare the measured shape of the pre-measured carrier with the target wafer thickness profile. For example, compare thicknesses between actual to target along diameters. Generate a map of target thickness variation between actual and target thickness over the wafer diameter.
   c. Using algorithms based in three-dimensional, solid model geometry to calculate wafer shape based on wafer size, grind wheel size and spindle alignments, determine the incremental pitch and roll that generate a best fit of a computed incremental thickness variation map to the measured target thickness variation map.
   d. Spindle pitch and roll is automatically, incrementally adjusted based on the result from a best fit of a computed incremental thickness variation map to the measured target thickness variation map. Again, the adjustments can be implemented to one or more grind wheel spindle adjustment screw assemblies 311, 703 described in concurrently filed U.S. Provisional Application No. 61/708,165, filed Oct. 1, 2012, entitled Methods and System for Use in Grind Spindle Alignment.
2. Grind the wafer.
3. Measure and implement a corrective adjustment (a corrective adjustment is one that causes incremental adjustments to spindle alignment, post-grind, to optimize ground wafer shaping to minimize variations from target device wafer thickness profile):

a. Perform post-grind wafer thickness measurements of the ground wafer thickness at a statistically significant number of points to support an accurate radial thickness profile, e.g., measure in a Tamar Wafer Scan system.
b. Compare the measured wafer thickness profile of the ground wafer with the target wafer thickness profile. For example, compare thicknesses between actual to target along diameters. Generate a map of target thickness variation between actual and target thickness over the wafer diameter.
c. Using algorithms based in three-dimensional, solid model geometry to calculate wafer shape based on wafer size, grind wheel size and spindle alignments, determine the incremental pitch and roll that generate a best fit of a computed incremental thickness variation map to the measured target thickness variation map.
d. Spindle pitch and roll is manually or automatically, incrementally adjusted based on the result from a best fit of a computed incremental thickness variation map to the measured target thickness variation map (e.g., adjustments similar to those described in concurrently filed U.S. Provisional Application No. 61/708,165, filed Oct. 1, 2012, entitled, Methods and System for Use in Grind Spindle Alignment.

4. In some embodiments, the above steps may be repeated for one or more subsequent ground wafer/carrier wafer pairs (e.g., a predefined number, randomly selected, etc.) or for each wafer pair.

Accordingly, some embodiments use spindle alignments to shape wafers during grinding. The effects of spindle alignment on wafer shape are used to minimize thickness variations relative to target wafer thickness profile. Further, some embodiments make incremental, predictive adjustments to spindle alignment, which can minimize variations to ground wafer target thickness profiles based on pre-grind carrier wafer measurements. Additionally, the incremental corrective adjustments can be made to spindle alignments to minimize variations to target thickness profiles based on post-grind wafer measurements. The adjustments are adaptive to varying shape targets and adaptive to varying environmental conditions, minimizing variation from target thickness profiles.

The present embodiments provide successful wafer grinding based on a target thickness profile, such as based on a pre-defined target shape of thin ground wafers to be ground. Some embodiments utilize metrology separate from a grind module to perform measurements of the ground wafer and/or the carrier wafer. In some instances, these measurements can be performed before a ground wafer and carrier wafer are attached together. The measurements can include measuring a three dimensional thickness profile of the carrier wafer.

Based at least in part on the thickness profile of the carrier wafer, a three-dimensional shape of material that is to be removed from the ground wafer is determined in order to obtain a ground wafer that has the target thickness profile. The grind module spindle alignment can be incrementally adjusted to achieve the desired three-dimensional removal from the ground wafer.

The definitive control in the grind module to implement the three-dimensional material removal from the ground wafer, in some embodiments, is achieved in part through one or more, or a combination of one or more grind wheel spindle alignments, chuck spindle alignments, adjustment of rotational speeds of chuck and grind wheel spindles, grind-force adjustments, spark-out control, chuck and grind wheel abrasive conditioning, grind coolant chemistry, grind coolant temperature and/or other such relevant parameters. That is, it is a complex process. In some embodiments, each grind module can be tested to be empirically characterized to define a basis for making appropriate adjustments affecting wafer shaping. In many instances, the defined grind module adjustments are unique to each grind module and process, which often may in part be defined by empirical testing of each grind module and may further be tested for the wafer material and diameter to be ground before the grind module is used.

Accordingly, the grind system can be implemented through a partially or fully automated process that makes incremental adjustments to achieve desired wafer profile. This automation can increase throughput of the wafers while further increasing the consistency of resulting wafers and decreasing the number of wafers that do not meet desired specifications.

In implementing the adjustments, the grind system is programmed to process wafer measurements and make the relevant adjustments to spindle alignment. In some embodiments, the grind system can include: One or more devices to measure ground wafer and/or carrier wafer shape and thickness; and one or more devices to automate spindle alignment.

Devices to Measure Ground Wafer and/or Carrier Wafer Shape and Thickness may include:

1. One or more sensors, which in some instances may be used in performing thickness measurements, such as:
   a. one or more mechanical contact probes, which may be used in some instances for total thickness of stacked or non-stacked wafers; and/or
   b. one or more IR-type probes, which may be used in some instances for stacked wafers or non-stacked wafers:
      i. For example, the IR-type probe can measure thickness of each wafer, as well as adhesives used to bond the wafers together.
      ii. One or more IR-type probes can also be used, such as but not limited to, when incoming carrier wafer shape is fed-forward for predictive adjustments and/or ground wafer shape is fed backward for corrective adjustments.
2. In some instances, onboard probes or sensors may not be needed or fewer probes or sensors may be employed when incoming wafer thickness (and shape of carrier wafer, if applicable) is fed-forward for predictive adjustments or fed-backward for corrective adjustments (also known as probeless grinding).
3. Combining a single sensor, e.g., one fixed-position contact probe or IR-type probe, with the combined motions of:
   a. wafer rotation on the grind chuck; and
   b. indexer motion to sweep across the wafer diameter to achieve a wafer shape and thickness map over some or the entire wafer; or
   c. a probe mounting arm with the capability to move a probe to measurement sites of the wafer.

Devices to Automate Spindle Alignment may include:

1. In some embodiments, the grind module employs one or more precision servo driven nut/screw assemblies and/or piezoelectric devices to adjust spindle pitch and/or roll. Other types of systems can additionally or alternatively be used to adjust the spindle alignment as well. For instance, hydro static or pneumatic static bearings may be strategically placed to affect spindle alignment.

2. The grind module can, in some implementations, further include one or more measurement probes and/or sensors to evaluate grind wheel spindle displacement for closed loop spindle movement and positioning.
3. One or more controllers (e.g., implemented through one or more processors, computers and the like) can be programmed with relevant algorithms that compare wafer by wafer actual shape and/or thickness to the desired target shape and/or thickness. The controller can also be aware of spindle alignment effects on wafer shape and thickness profile, and can also control the spindle alignment hardware.

Figure 8:
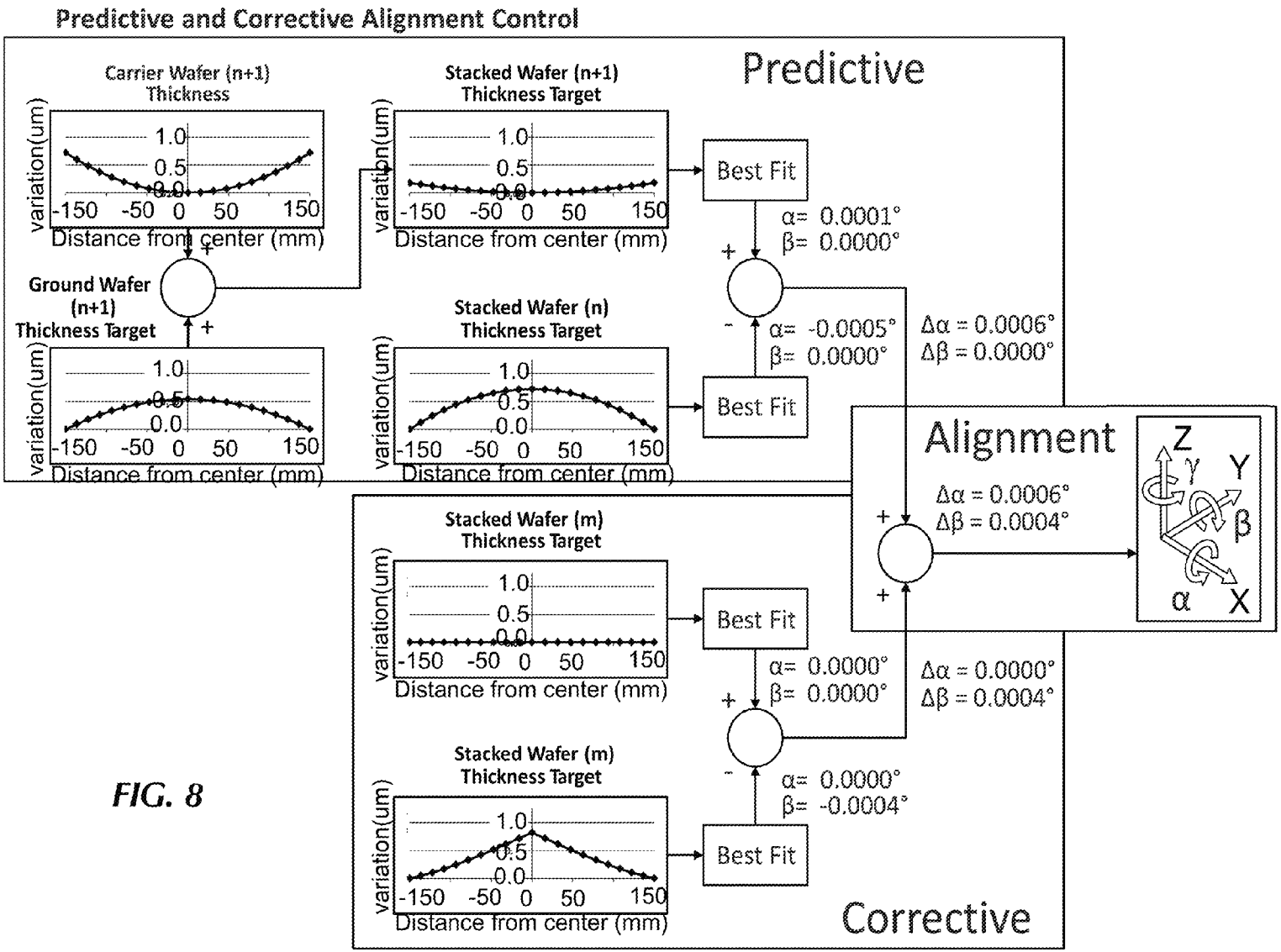
FIG. 8 is a graphical example of a control loop simultaneously employing predictive and corrective alignment control.

Accordingly, the controller or computer is able to command changes in spindle alignment to achieve minimal variation with target shape and/or thickness. In some implementations, the controller employs a best fit approach in the alignment and shaping control, such as a least squares approach to measured data. Some embodiments further employ control loops, such as proportional, integral, derivative controllers (PID) and linear quadratic estimation (LQE) to achieve a stable convergence to spindle alignment. FIG. 8 is a graphical example of a control loop simultaneously employing predictive and corrective alignment control.

The present embodiments provide spindle alignment methods without the need for an experienced technician or process engineer to align the spindles. These prior manual processes are labor intensive, typically take too long, often employ trial and error procedures, and are not easily adaptive to environmental and carrier wafer variations.

Further, the present embodiments automate initial spindle alignments, and in many embodiments enable automatic, continuous, spindle alignment for both stacked and single wafers. Additionally, wafer to wafer adaptability for wafer shaping is enabled. In many instances, the automated adjustments reduce setup times, substantially reduce thickness variation of ground wafer shape and/or thickness to target wafer shape and/or thickness, reduced the number of rejected wafers and improves throughput. Adjustments can be implemented based on predictive and/or corrective, automated spindle alignments, which can reduce or eliminate the need for manual alignment procedures, while further enabling wafer specific shaping and/or the adaptive wafer shaping.

In some methods, in accordance with some embodiments, use this equipment and algorithms to first shape the grind chuck by adjusting the relative angle between the grind wheel spindle to grind-chuck spindle (for example, for a given wafer diameter and cutting stone diameter of the chuck-grinding wheel) to a desired shape. Then, second, grind the wafer to desired surface shape by adjusting the relative spindle alignment base upon known chuck shape, etc. as described above and below in accordance with some examples.

FIG. 9 illustrates a first example of using algorithms based in three dimensional solid model geometry to correlate:

chuck shape to wafer size, grind wheel size and spindle alignments; and wafer shape to chuck shape, wafer size, grind wheel size and spindle alignments.

FIG. 10 illustrates a second example of using algorithms based in three dimensional solid model geometry to correlate:

chuck shape to wafer size, grind wheel size and spindle alignments; and wafer shape to chuck shape, wafer size, grind wheel size and spindle alignments.

The second example in FIG. 10 differs from the first example in FIG. 9 in that relative to chuck shaping, the roll was changed −0.00075°, from +0.00050° to −0.00025° and pitch was changed +0.00038° from 0.00000° for the wafer grind.

FIG. 11 illustrates a third example of using algorithms based in three dimensional solid model geometry to correlate:

chuck shape to wafer size, grind wheel size and spindle alignments; and wafer shape to chuck shape, wafer size, grind wheel size and spindle alignments.

The third example in FIG. 11 starts with a chuck shape generated from a roll of −0.00063° and no pitch. Relative to chuck shaping, the roll was changed +0.00038° from −0.00063° to −0.00025°, with no changes in pitch for the wafer grind.

FIG. 12 illustrates a fourth example of using algorithms based in three dimensional solid model geometry to correlate:

chuck shape to wafer size, grind wheel size and spindle alignments; and wafer shape to chuck shape, wafer size, grind wheel size and spindle alignments.

The fourth example in FIG. 12 differs from the third example in FIG. 11 in that relative to chuck shaping, the roll was changed −0.00037° from −0.00063° to −0.00100° with no changes in pitch for the wafer grind.

Figure 13:
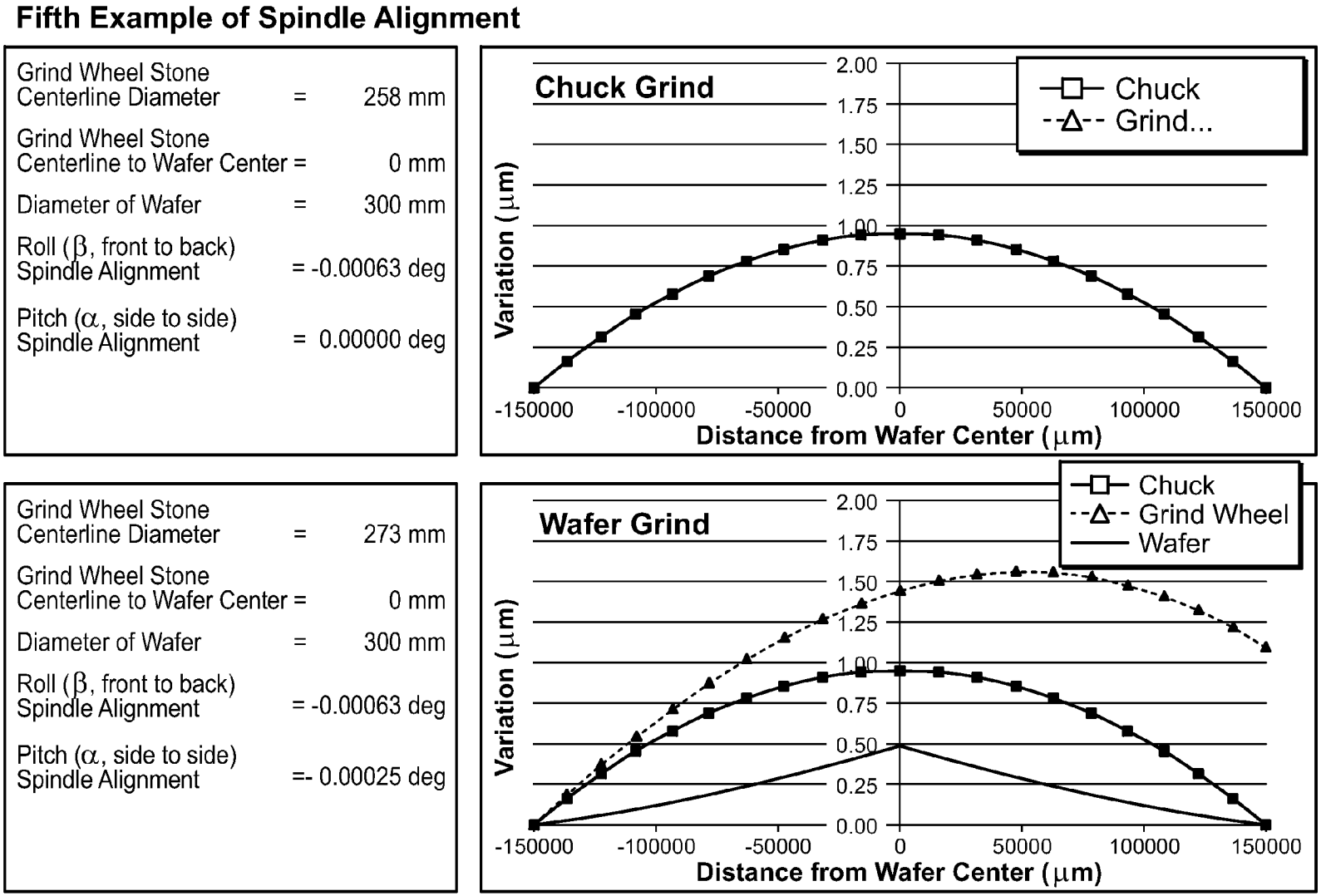
FIG. 13 illustrates a fifth example of using algorithms based in three dimensional solid model geometry to correlate: chuck shape to wafer size, grind wheel size and spindle alignments; and wafer shape to chuck shape, wafer size, grind wheel size and spindle alignments.

FIG. 13 illustrates a fifth example of using algorithms based in three dimensional solid model geometry to correlate:

chuck shape to wafer size, grind wheel size and spindle alignments; and wafer shape to chuck shape, wafer size, grind wheel size and spindle alignments.

The fifth example in FIG. 13 differs from the third example in FIG. 11 in that relative to chuck shaping, there is no change in roll and a pitch was changed −0.00025° from 0.00000° to −0.00025° for the wafer grind.

FIG. 14 illustrates a sixth example of using algorithms based in three dimensional solid model geometry to correlate:

chuck shape to wafer size, grind wheel size and spindle alignments; and wafer shape to chuck shape, wafer size, grind wheel size and spindle alignments.

The sixth example in FIG. 14 differs from the third example in FIG. 11 in that relative to chuck shaping, there is no change in roll and pitch was changed +0.00025° from 0.00000° to +0.00025° for the wafer grind.

Accordingly, adjustments can be implemented to compensate for variations in carrier wafer thickness profile.

One or more controllers, controlling computers and/or processors are included in and/or cooperated with the grind module of the present embodiments to provide control of the components and/or processes. Typically the controller receives sensor data and controls the grinding, cleaning, dressing, polishing, wafer moving and/or other processing. The controller or controllers can be implemented through one or more processors, controllers, central processing units, computers, logic, software and the like. Further, in some implementations the controller(s) may provide multiprocessor functionality. Computer and/or processor accessible memory can be included in the controller and/or accessed by the controller. In some embodiments, memory stores executable program code or instructions that when executed by a processor of the grind module controller cause the grind module, system and/or tool to control the one or more components. Additionally, the code can cause the implementation of one or more of the processes and/or perform one or more functions such as described herein.

The methods, techniques, systems, devices, services, servers, sources and the like described herein may be utilized, implemented and/or run on many different types of devices and/or systems. These devices and/or systems may be used for any such implementations, in accordance with some embodiments. One or more components of the system may be used for implementing any system, apparatus or device mentioned above or below, or parts of such systems, apparatuses or devices, such as for example any of the above or below mentioned controllers, as well as user interaction system, sensors, feedback, displays, controls, detectors, motors and the like. However, the use of one or more of these systems or any portion thereof is certainly not required.

The memory, which can be accessed by the processors and/or controllers, typically includes one or more processor readable and/or computer readable media accessed by at least the processors and/or controllers, and can include volatile and/or nonvolatile media, such as RAM, ROM, EEPROM, flash memory and/or other memory technology. Further, the memory can be internal to the system; however, the memory can be internal, external or a combination of internal and external memory.

The external memory can be substantially any relevant memory such as, but not limited to, one or more of flash memory secure digital (SD) card, universal serial bus (USB) stick or drive, other memory cards, hard drive and other such memory or combinations of such memory. The memory can store code, software, executables, grind recipes, scripts, data, coordinate information, programs, log or history data, user information and the like.

Other embodiments provide alternate or additional alignment adjustment systems. For example, some embodiments may include piezoelectric devices used to move the grind spindle 308, although relatively high electrical voltage may be needed with these embodiments.

Figure 15:
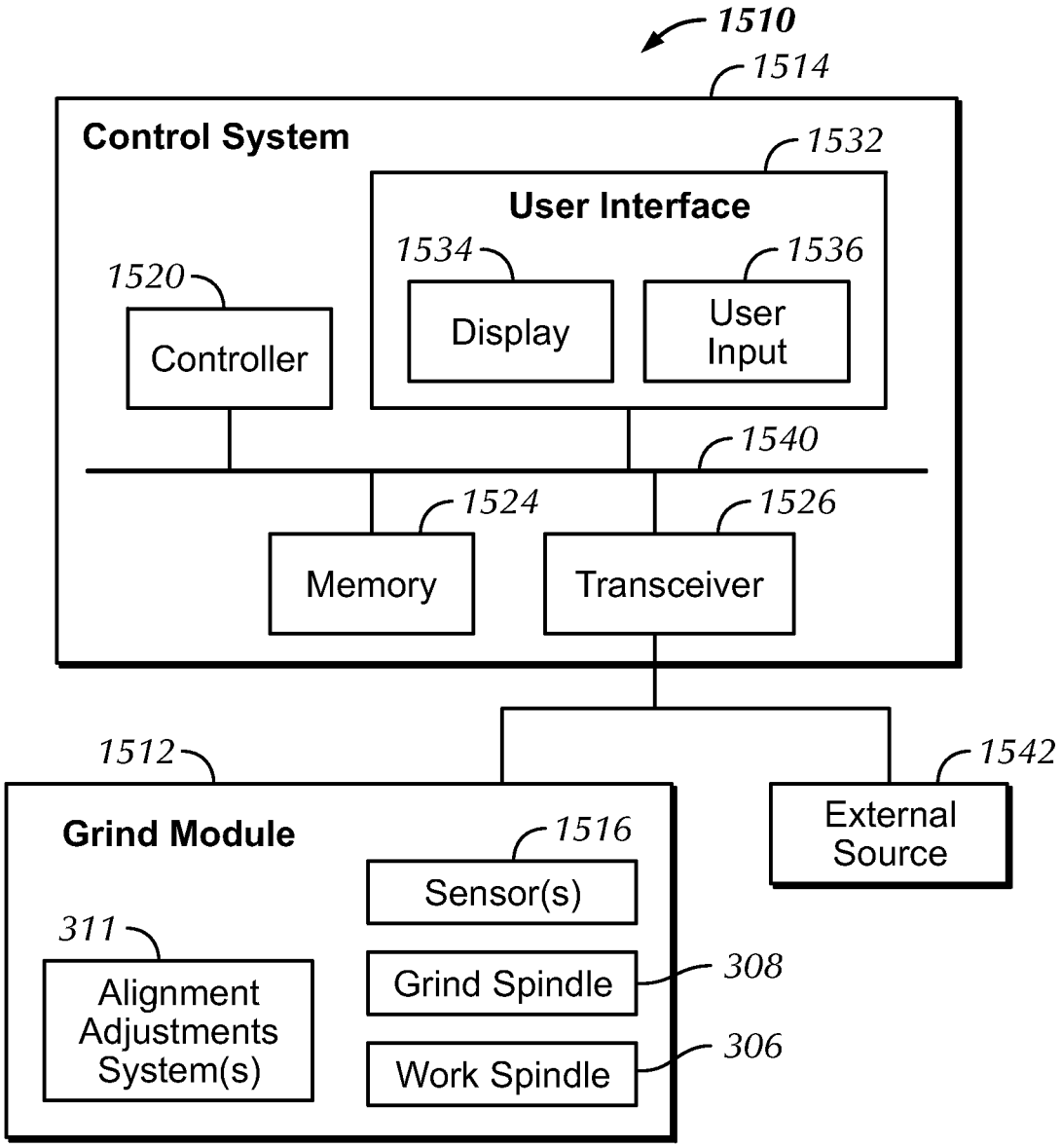
FIG. 15 depicts a simplified block diagram of a grind system 1510, according to some embodiments, that can be used to grind and/or polish wafers or other relevant work objects.

FIG. 15 depicts a simplified block diagram of a grind system 1510, according to some embodiments, that can be used to grind and/or polish wafers or other relevant work objects. The grind system 1510 includes a grind module 1512 and a controller or control system 1514. The grind module 1512 can include the grind spindle 308, the work spindle 306, one or more alignment adjustment systems or spindle adjustment assemblies 311 and/or 703, one or more sensors or probes 1516 and other components including those described above.

The control system 1514 couples with the sensors and/or probes 1516 to receive measured or sensor data, such as but not limited to thickness, thickness variation, distance information, occurrences of contact, orientation, angles, speed of rotation, distance or amount of rotation of the motors 512, and/or other such relevant information. For example, the sensors 1516 can include sensors described in U.S. Provisional Application No. 61/549,787. The control system 1514 further can couple with one or more motors 512 of the spindle adjustment assemblies 311. Utilizing the sensor information and/or other information (e.g., wafer surface measurements and the like, desired surface results, etc.) the control system 1514 can determine alignment adjustments to be made. Once adjustments are determined, the control system 1514 can activate one or more of the spindle adjustment assemblies 311 to implement the desired alignment and/or provide adjustment information to a user. The sensors 1516 can continue to provide information as feedback to the control system 1514 allowing the control system to continue to implement adjustments to achieve the desired alignment. Accordingly, the alignment can be achieved through one or more fully or partially automated processes.

The control system 1514 can be incorporated as part of the grind module 1512 or partially or fully separate from the grind module. Further, the control system can be implemented through one or more devices or systems that can be implemented through hardware, software or a combination of hardware and software. By way of example, the control system 1514 may additionally comprise a controller or processor module 1520, memory 1524, a transceiver 1526, a user interface 1532, and one or more communication links, paths, buses or the like 1540. A power source or supply (not shown) is included or coupled with the control system 1514.

The controller 1520 can be implemented through one or more processors, microprocessors, computers, controllers, central processing unit, logic, local digital storage, firmware and/or other control hardware and/or software, and may be used to execute or assist in executing the steps of the methods and techniques described herein, and control various communications, programs, content, listings, services, interfaces, etc. The memory 1524, which can be accessed by the controller 1520, typically includes one or more processor readable and/or computer readable media accessed by at least the controller 1520, and can include volatile and/or nonvolatile media, such as RAM, ROM, EEPROM, flash memory and/or other memory technology. Further, the memory 1524 is shown as internal to the control system 1514; however, the memory 1524 can be internal, external or a combination of internal and external memory. The external memory can be substantially any relevant memory such as, but not limited to, one or more of flash memory secure digital (SD) card, universal serial bus (USB) stick or drive, other memory cards, hard drive, memory accessible via a network, and other such memory or combinations of such memory. The memory 1524 can store code, software, executables, scripts, data, graphics, parameter information, alignment information, wafer characteristics and/or shapes, textual content, identifiers, log or history data, user information and the like.

In some embodiments, the grind system 1510 and/or the control system 1514 can include a user interface 1532. The user interface can allow a user to interact with the grind system 1510 and/or the control system 1514, provide information to the grind system 1510 and/or receive information through the grind system 1510. In some instances, the user interface 1532 includes a display 1534 and/or one or more user inputs 1536, such as keyboard, mouse, track ball, touch pad, buttons, touch screen, a remote control, etc., which can be part of or wired or wirelessly coupled with the grind system 1510 or control system 1514.

Typically, the control system 1514 further includes one or more communication interfaces, ports, transceivers 1526 and the like allowing the control system 1514 to communicate with the spindle adjustment assemblies 311, the sensors and/or probes 1516, the grind spindle or grind spindle motor(s), the work spindle or work spindle motor(s), and/or other devices or sub-systems of the grind system 1510. Additionally, in some embodiments, the transceiver 1526 may provide communication over the communication link 1540, a distributed network, a local network, the Internet, and/or other networks or communication channels to communicate with other devices, systems or sources 1542, and/or provide other such communications. Further the transceiver 1526 can be configured for wired, wireless, optical, fiber optical cable or other such communication configurations or combinations of such communications.

The one or more sensors and/or probes 1516 are shown as internal to the grinding engine 300; however, the one or more sensors and/or probes 1516 can be internal, external or a combination of internal and external sensors (e.g., separate system that can, for example, provide radial thickness profile information of a wafer). The one or more sensors 1516 and sensor information provided from the one or more sensors can be used to determine alignment of the grind spindle 308, wafer or work spindle 306, wafer surface, chuck surface, grind surface of the wheels 307 and/or other relevant alignment information, rotational speed, pressure, distance, height, temperature, thickness, wafer profile, wafer characteristics, or substantially any other relevant parameter that can be sensed, or combinations of such sensors.

Figure 16:
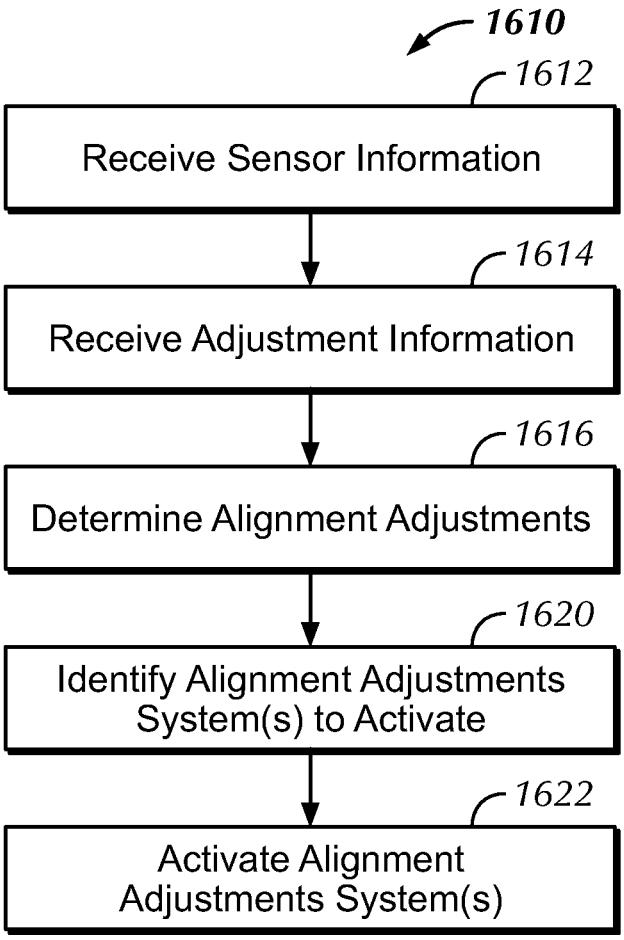
FIG. 16 shows a simplified flow diagram of a process, according to some embodiments, of implementing adjustments to alignment between a grind spindle and a work spindle providing a desired alignment between a grind wheel surface and a surface of a wafer (or other work product being ground or polished) to achieve a desired resulting shape of the wafer.

FIG. 16 shows a simplified flow diagram of a process 1610, according to some embodiments, of implementing adjustments to alignment between the grind spindle 308 and the work spindle 306 providing the desired alignment between the grind wheel surface and the surface of the wafer (or other work product being ground or polished) to achieve the desired resulting shape of the wafer. In optional step 1612, the control system 1514 receives sensor and/or probe information regarding at least the relative positioning of the grind spindle 308 and the work spindle 306. Some embodiments additionally or alternatively include optional step 1614, where the control system receives adjustment information from another source 1542. For example, a wafer evaluation system that evaluates the shape of a carrier wafer, the wafer to be ground, a previously ground wafer, information about the carrier wafer and/or alignment adjustment information based on the shape of a carrier wafer, information about an evaluation of a ground wafer in confirming alignment, or other such information or combinations of such information.

In step 1616, the alignment adjustments are determined to achieve the desired alignment. The determination of the alignment adjustments to implement can, in some embodiments, include some or all of the information determined and described in U.S. Provisional Application No. 61/549,787. Other information can be used or determined based on other factors. Further, the alignment adjustments to implement can be determined based on the sensor information or other information, including information that might be provided by an external source 1542. Still further, step 1616 can be implemented by the control system 1514 using the relevant sensor information and/or other relevant information. In some embodiments, the alignment adjustments and/or part of the alignment adjustments to implement may be provided by an external source 1542. In step 1620, one or more of the spindle adjustment assemblies 311 are identified to be activated, and an amount of adjustment is determined for each identified alignment adjustment systems. For example, an angle of adjustment can be calculated, and based on the angle of adjustment the amount of rotation can be determined (e.g., number of rotations and/or amount of partial rotation) for each motor of the one or more identified spindle adjustment assemblies.

In step 1622, the one or more spindle adjustment assemblies 311 are activated to implement the determined adjustments and/or manual adjustments are applied. The process 1610 may be repeated one or more times depending on subsequent measurements, subsequent sensor information, confirmation steps, and/or other such information. For example, in some instances, a wafer may be ground and the ground wafer evaluated to determine whether further adjustments are to be implemented.

One or more of the embodiments, methods, processes, approaches, and/or techniques described above or below may be implemented, at least in part, through one or more computer programs executable by one or more processor-based systems. By way of example, such a processor based system may comprise a processor based control system 1514, a computer, a dedicated processing systems, tablet, etc. Such a computer program may be used for executing various steps and/or features of the above or below described methods, processes and/or techniques. That is, the computer program may be adapted to cause or configure a processor-based system to execute and achieve the functions described above or below. For example, such computer programs may be used for implementing any embodiment of the above or below described steps, processes or techniques for providing alignment, grinding and/or polishing. As another example, such computer programs may be used for implementing any type of tool or similar utility that uses any one or more of the above or below described embodiments, methods, processes, approaches, and/or techniques. In some embodiments, program code modules, loops, subroutines, etc., within the computer program may be used for executing various steps and/or features of the above or below described methods, processes and/or techniques. In some embodiments, the computer program may be stored or embodied on a non-transitory computer readable storage or recording medium or media, such as any of the computer readable storage or recording medium or media described herein.

Accordingly, some embodiments provide a processor or computer program product comprising a medium configured to embody a computer program for input to a processor or computer and a computer program embodied in the medium configured to cause the processor or computer to perform or execute steps comprising any one or more of the steps involved in any one or more of the embodiments, methods, processes, approaches, and/or techniques described herein. For example, some embodiments provide one or more computer-readable storage mediums storing one or more computer programs for use with a computer simulation, the one or more computer programs configured to cause a computer and/or processor based system to execute steps comprising: determining thickness variations in a wafer; determine incremental adjustments to spindle alignment (e.g. pitch and/or roll) based on best fit predictions of wafer shape; and implementing the incremental adjustments to spindle alignment of a grind module.

Other embodiments provide one or more computer-readable storage mediums storing one or more computer programs configured for use with a computer simulation, the one or more computer programs configured to cause a computer and/or processor based system to execute steps comprising: determining alignment adjustments relative to a grind spindle; and automatically implementing the adjustments.

Some embodiments provide at least a partially or fully automated process for implementing the alignment between the grind spindle 308 and the work spindle 306 achieving the desired alignment between the grind wheel surface and the surface of the wafer. Further, some embodiments provide motors cooperated with the spindle adjustment assemblies to simplify the alignment, and in some instances enhance the precision of alignment. Additionally, some embodiments provide a reduction in rotational ratio between the motor and the spindle adjustment assemblies providing highly precision alignments. Still further, some embodiments utilize feedback to achieve the desired alignment, such as through sensors or probes.

Control of the alignment can be partially or fully automated. Accordingly, some embodiments are provided with desired resulting wafer shapes, and the system can calculate alignment positioning and activate the alignment adjustment systems to provide the alignment between the work spindle and the grid spindle to achieve the alignment that can produce the resulting wafer with the desired shape. The precision alignment can allow substantially any relevant alignment and/or to compensate for variations, including with carrier wafers. Further still, the partially or fully automated alignment adjustments can allow for optimal grinding of each distinct wafer. Similarly, the partially or fully automated alignment adjustments can allow for optimal grinding of each distinct wafer based upon corresponding carrier wafer shape with high production fabrication processes and/or facilities.

What is claimed is:

1. A method of grinding wafers, comprising:

determining thickness variations in a wafer;

determining incremental adjustments to spindle alignment based on best fit predictions of wafer shape; and implementing the incremental adjustments to spindle alignment of a grind module;

wherein said determining of said incremental adjustments to the spindle alignment is at least in part in response to a predictive adjustment, the predictive adjustment causing said incremental adjustments;

wherein said predictive adjustment is determined in response to said determining of said thickness variations in a wafer comprising pregrind wafer thickness measurements of a carrier wafer, comparing the thickness measurements to a target wafer thickness profile, and detennining wafer shape based on wafer size, grind wheel size and said spindle alignment.

2. The method of claim 1 wherein said determining of said incremental adjustments to spindle alignment is at least in part in response to a corrective adjustment, the corrective adjustment further causing said incremental adjustments.

3. The method of claim 1 wherein:

said predictive adjustment is determined in response to said determining of said thickness variations in a wafer comprising pre-grind wafer thickness measurements of a carrier wafer, comparing the thickness measurements to a target wafer thickness profile, and determining wafer shape based on wafer size, grind wheel size and said spindle alignment; and wherein said corrective adjustment is determined in response to said determining of said thickness variations in a wafer comprising post-grind wafer thickness measurements of a first ground wafer, comparing the thickness measurements to the target wafer thickness profile, and determining wafer shape based on wafer size, grind wheel size and said spindle alignment.

* * * * *